US006289642B1

(12) United States Patent
Diamond

(10) Patent No.: US 6,289,642 B1
(45) Date of Patent: Sep. 18, 2001

(54) METHOD AND WINDOW STRUCTURE IN BUILDINGS FOR PROTECTING GLASS PANES DURING STORMS

(75) Inventor: Jeffrey H. Diamond, Palm Beach, FL (US)

(73) Assignee: Aranar, Inc., West Palm Beach, FL (US)

( * ) Notice: Subject to any disclaimer, the term of this patent is extended or adjusted under 35 U.S.C. 154(b) by 0 days.

(21) Appl. No.: 09/362,890

(22) Filed: Jul. 29, 1999

(51) Int. Cl.[7] ..... E06B 7/16

(52) U.S. Cl. ..... 52/202; 52/DIG. 12; 52/741.3; 52/309.8; 52/742.13; 427/154; 427/244; 427/421; 427/407.2

(58) Field of Search ..... 52/203, DIG. 12, 52/742.13, 309.8, 202, 167.1, 741.3, 515; 427/154, 244, 421, 407.2

(56) References Cited

U.S. PATENT DOCUMENTS

| | | | | |
|---|---|---|---|---|
| 1,239,089 | * | 9/1917 | Day | 428/198 |
| 2,020,256 | * | 11/1935 | Copeman | 91/68 |
| 2,784,114 | * | 3/1957 | Miller | 117/93 |
| 3,091,551 | * | 5/1963 | Robertson | 117/105.5 |
| 3,455,865 | | 7/1969 | Bolt et al. . | |
| 3,480,069 | * | 11/1969 | Handwerker | 52/202 |
| 3,486,918 | | 12/1969 | Motter . | |
| 3,549,448 | * | 12/1970 | Dearing | 156/250 |
| 3,830,760 | | 8/1974 | Bengtson . | |
| 4,010,311 | * | 3/1977 | Lewis et al. | 428/424 |
| 4,075,386 | * | 2/1978 | Willdorf | 428/216 |
| 4,145,855 | * | 3/1979 | Sheldon | 52/232 |
| 4,596,725 | | 6/1986 | Kluth et al. . | |
| 4,616,456 | * | 10/1986 | Parker | 52/202 |
| 4,636,425 | * | 1/1987 | Johnson et al. | 428/198 |
| 4,636,543 | | 1/1987 | Helton . | |
| 4,971,130 | * | 11/1990 | Bentley | 160/368.1 |
| 5,004,632 | * | 4/1991 | McGarvey et al. | 427/410 |
| 5,020,288 | * | 6/1991 | Swensen | 52/DIG. 12 X |
| 5,107,643 | * | 4/1992 | Swensen | 52/202 |
| 5,143,949 | | 9/1992 | Grogan et al. . | |
| 5,186,978 | | 2/1993 | Woodhall et al. . | |
| 5,194,299 | * | 3/1993 | Fry | 427/208.6 |
| 5,230,738 | * | 7/1993 | Wheeler | 52/DIG. 12 X |
| 5,281,436 | | 1/1994 | Swidler . | |
| 5,302,413 | | 4/1994 | Woodhall et al. . | |
| 5,362,786 | | 11/1994 | Woodhall et al. . | |
| 5,411,760 | | 5/1995 | Woodhall et al. . | |
| 5,468,538 | * | 11/1995 | Nameche | 428/101 |
| 5,484,820 | * | 1/1996 | Mispreuve et al. | 521/174 |
| 5,523,117 | | 6/1996 | Woodhall et al. . | |
| 5,538,779 | * | 7/1996 | Mispreuve et al. | 428/220 |
| 5,603,190 | * | 2/1997 | Sanford | 52/202 |
| 5,866,260 | * | 2/1999 | Adams Jr. et al. | 428/426 |
| 5,918,430 | * | 7/1999 | Rowland | 52/202 |
| 5,937,595 | * | 8/1999 | Miller | 52/202 |
| 5,937,596 | * | 8/1999 | Leeuwenburgh et al. | 52/202 |
| 5,943,832 | * | 8/1999 | Russell | 52/202 |

* cited by examiner

*Primary Examiner*—Carl D. Friedman
*Assistant Examiner*—Phi Dieu Tran A

(57) ABSTRACT

A method of protecting glass panes in window structures installed in buildings includes applying a polymeric foam layer to the glass pane before the storm has arrived and peeling the polymeric foam layer from the glass pane after the storm has passed. The polymeric foam layer can be a polyurethane foam, provided as a one-component system or a two-component system, and the polyurethane foam can be sprayed onto the exterior surface of the glass pane to prevent damage thereto including shattering while absorbing energy from wind-borne debris. A window structure installed in a building includes a glass pane mounted to a frame with a polyurethane foam layer disposed thereon for protection of the glass pane during storms.

18 Claims, 2 Drawing Sheets

METHOD AND WINDOW STRUCTURE IN BUILDINGS FOR PROTECTING GLASS PANES DURING STORMS

BACKGROUND OF THE INVENTION

1. Field of the Invention

The present invention relates to protection of glass windows during storm conditions and, more particularly, to the use of a polymeric foam layer applied to the exterior of a glass pane to protect the glass pane from shattering and from damage due to high winds and wind-borne debris.

2. Discussion of the Prior Art

Protection of glass panes in buildings during storms has been a great problem in the past, and many efforts have been made to prevent the glass panes from shattering and falling into the building due to high winds, projectiles and debris thereby damaging the interior of the building due to the glass and due to wind and rain damage through the breached glass pane. Prior art attempts to protect glass panes in buildings from storm damage have included prefabricated storm shutters, plywood sheets, lamination systems and taping. Storm shutters are normally made of aluminum or other lightweight metal alloys, fiberglass, acrylate or other plastic. Storm shutters are fabricated to fit the exact measurements of window structures, including glass panes, to be protected and have the disadvantages of being expensive and requiring substantial time for fabrication such that storm shutters are not available unless ordered well in advance of a storm. Plywood sheets are generally sold in four-foot by eight-foot sheets with a thickness of ⅝ inch such that the plywood sheets weigh approximately 50 pounds each. The plywood sheets must be cut to fit the size of the window structures and are normally drilled and screwed into the building or window frame requiring craftsmanship, labor and hardware and, thus, having the disadvantages of being expensive and requiring substantial time to cover windows when a storm is approaching as well as of being extremely heavy. Lamination systems, such as those supplied by 3M Corporation (e.g. Scotchshield) have the disadvantages that they are films applied to the interior of the glass panes in that they are designed to prevent shattered glass from collapsing to thereby prevent rain damage and glass fragments from becoming projectiles. The film is not particularly effective in preventing the glass from shattering and does not make the glass more shatter resistant. Since the film is on the interior of the glass, it cannot absorb enough energy from the glass fast enough to prevent a failure or fracture of the glass if the glass pane is struck by debris or projectiles. Accordingly, the primary use of lamination systems is to prevent shattered glass from falling apart. Taping of windows results, at best, in the holding of most of a fractured glass pane in place to reduce rain damage and the risk of individuals being cut.

U.S. Pat. No. 3,830,670 to Bengston and No. U.S. Pat. No. 4,596,725 to Kluth et al are exemplary of polyurethane foams and discuss one-component and two-component polyurethanes. U.S. Pat. No. 3,455,865 to Bolt et al, U.S. Pat. No. 3,486,918 to Motter, U.S. Pat. No. 4,636,543 to Helton, U.S. Pat. No. 5,020,288 to Swenson, U.S. Pat. No. 5,107,643 to Swenson, U.S. Pat. No. 5,143,949 to Grogan et al, U.S. Pat. No. 5,186,978 to Woodhall et al, U.S. Pat. No. 5,281,436 to Swidler, U.S. Pat. No. 5,302,413 to Woodhall et al, U.S. Pat. No. 5,362,786 to Woodhall et al, U.S. Pat. No. 5,411,760 to Woodhall et al and U.S. Pat. No. 5,523,117 to Woodhall et al, are representative of polymeric films or layers for glass and/or polymeric films or layers removable by peeling. None of the above patents disclose or contemplate the use of a polymeric foam to protect a glass pane of a window structure installed in a building for protection against damage from storms.

From the above, it will be appreciated that there is a great need for protection of glass panes in window structures installed in buildings due to storms where the protection can be quickly applied and is inexpensive while also being easily removed.

SUMMARY OF THE INVENTION

Accordingly, it is an object of the present invention to provide protection for glass panes overcoming the above-mentioned disadvantages of the prior art.

Another object of the present invention is to protect glass panes in buildings from storm damage by temporarily applying or adhering a polymeric foam layer on the glass pane and, after the storm passes, removing the polymeric foam layer by peeling or stripping the layer from the glass pane.

A further object of the present invention is to apply a polyurethane foam layer to a glass pane of a window structure in a building to absorb energy from debris during a storm and to maintain the integrity of the glass pane in the event of damage thereto.

Another object of the present invention is to adhere a polyurethane foam layer to the outside surface of a glass pane to produce a temporarily protected window structure in a building.

Some of the advantages of the present invention over the prior art are that the polymeric foam layer protects glass panes from shattering in wind storms, is easy to apply, and can be applied by spraying in substantially less time than required for other glass pane protection systems with no measuring required, containers for the compositions of the polymeric foam layer can be small, the weight of the polymeric foam layer is insubstantial, the polymeric foam layer can be easily removed by peeling from the exterior window structure surface either from the exterior of the building or, if the windows can be opened, from the interior of the building, a two-component polyurethane system provides long shelf life such that an individual can be prepared at all times, the polymeric foam layer can be installed by one person, is translucent to let light in and will not lose its shape or protective qualities when wet by rain.

The present invention is generally characterized in a method of protecting a glass pane installed in a building from damage during a storm comprising the steps of before the storm arrives, applying a polymeric foam layer to the exterior of the glass pane and, after the storm has passed, peeling the polymeric foam layer from the glass pane. Preferably, the polymeric foam layer is a polyurethane foam having cells absorbing energy from wind-borne debris, wind and driven rain. The present invention is further generally characterized in a window structure installed in a building comprising a glass pane having an exterior surface, a frame mounting the glass pane to the buildings and a layer of polyurethane foam disposed on the exterior surface of the glass pane for protecting the glass pane from storm damage, the layer of polyurethane foam being peelable for removal from the glass pane.

Other objects and advantages of the present invention will become apparent from the following description of the preferred embodiments taken in conjunction with the accompanying drawings wherein like parts in each of the several figures are identified by the same reference characters.

DESCRIPTION OF THE PREFERRED EMBODIMENTS

Figure 1:
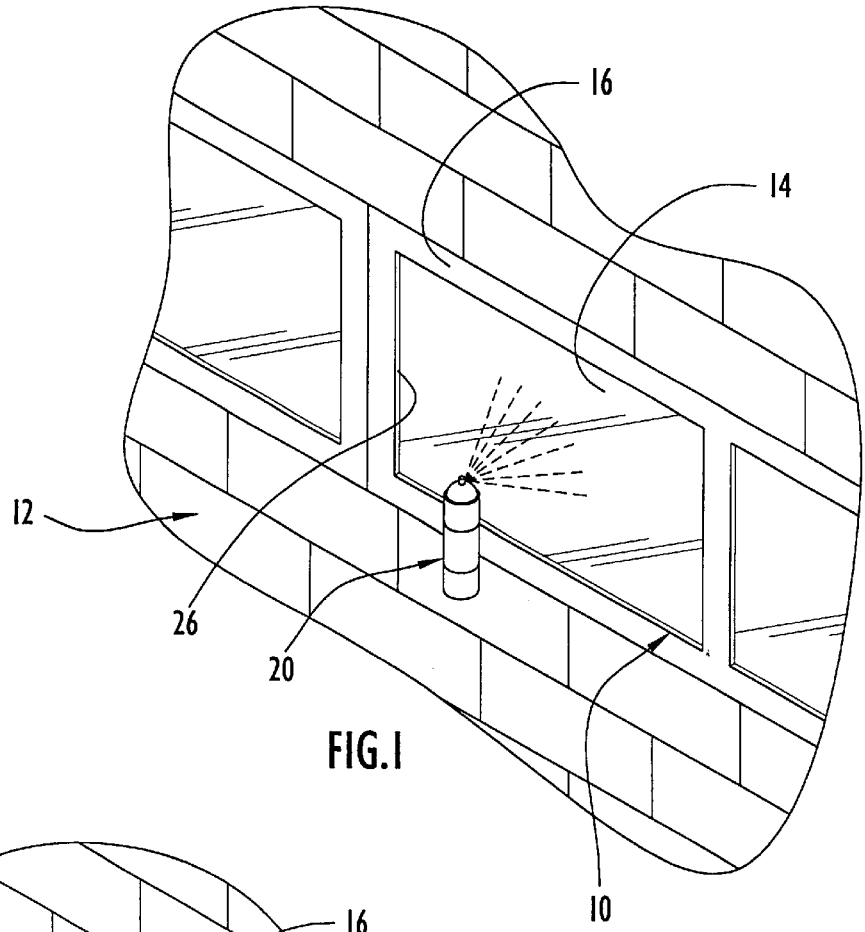
FIG. 1 is a perspective view of a window structure installed in a building with a polymeric foam layer being applied thereto in accordance with the present invention.
Figure 2:
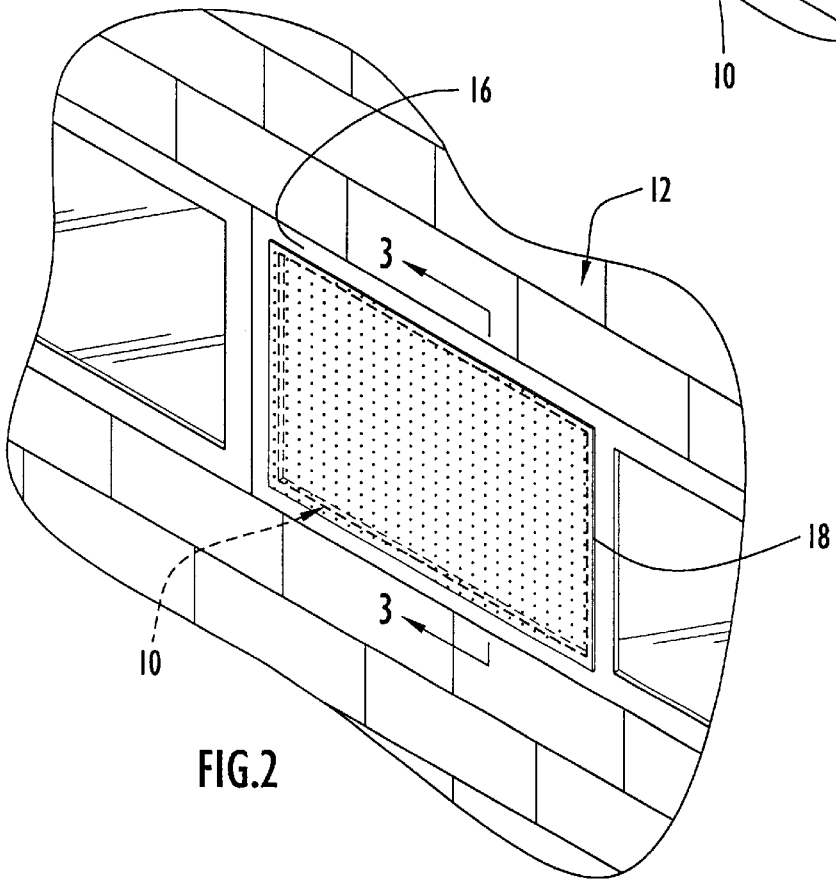
FIG. 2 is a perspective view of the window of FIG. 1 with a polymeric foam layer thereon.
Figure 3:
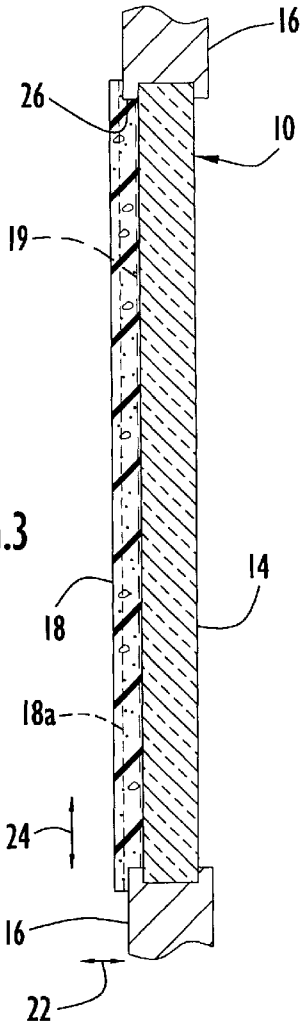
FIG. 3 is a section taken along line 3—3 of FIG. 2.

As shown in FIG. 1, the present invention relates to application of a polymeric foam film or layer to a glass window structure 10 in an existing building 12, the glass window structure including a glass pane 14 mounted by a frame 16. The building 12 can be of any type, residential or commercial, and of any conventional construction. The glass window structure 12 can be of any conventional construction where one or more glass panes are held in place in a frame of one or multiple parts surrounding the glass pane, such as sash windows, casement windows, sliding glass doors, slidably or pivotally movable windows, non-movable windows, protruding windows and recessed windows. The polymeric foam film or layer 18 is applied to the window structure to create a temporary shield for the glass pane. The polymeric foam layer can be applied in any suitable manner dependent on the polymeric composition to adhere to the glass pane. In a preferred embodiment, the polymeric foam layer 18 is formed by a polyurethane with a propellant causing the polyurethane to form foam upon application by spraying onto the window structure when a storm is expected to form layer 18 overlying the glass pane 14 and, in most cases, a portion of the frame 16 as shown in FIGS. 2 and 3. Dependent upon the location of the window structure 10 in the building 12, the polyurethane can be sprayed by a hand-held spraying device 20 or a remotely controlled spraying device mounted on a pole extendible to be positioned adjacent window structures to be protected. Other polymeric foams can be utilized in accordance with the present invention including modified styrene foams, particularly high impact styrene foams modified with polybutadiene.

The polyurethane can be provided as a one-component or two-component system. The two-component system has a first chamber containing a polymeric polyol and a second chamber containing a diisocyanate with a mixing head to statically blend the polyol and diisocyanate components and to spray the polymeric blend or mix onto the window structure. The one-component system contains a polymeric/polyol, polyurethane prepolymer and a polymeric hydrocarbon propellant such that mixing takes place in the spraying device or container and moisture curing occurs on the surface of the window structure.

Since polyurethanes are very adhesive by nature, a release agent can be added to the one-component or two-component systems to adjust the adhesive properties of the polyurethane foam layer to the glass pane and a portion of the frame. The adhesive properties of the polyurethane foam layer could also be adjusted by altering the molecular structure of the polyurethane or the exterior surface of the glass pane could be coated with the release agent that would reduce the adhesion of the polyurethane layer thereto in a manner such that an adhesive balance is achieved whereby the polyurethane layer remains in place during a storm but is easy to remove by peeling or stripping. Additionally, as shown in FIG. 3, a film can be applied prior to application of the polymeric foam layer with the film carrying a releasable or low-adherency, non-permanent, pressure sensitive adhesive to facilitate removal of the polymeric foam layer by the film acting as a release agent.

The polyurethane foam layer should have twice as great compression strength in a direction parallel to the foam rise which is perpendicular to the glass pane as shown by arrow 22, as compared with the compression strength in a direction perpendicular to foam rise, shown by arrow 24, as illustrated in FIG. 3. The compressive strength and other physical strength properties of the polyurethane foam layer will vary with the type of foaming system utilized. Compressive strength values from 15 to 40 psi can be obtained with 2 $lb/ft^3$ density urethane foams. A compressive strength of 30 psi can be obtained with foam densities from 1.0 to 10.0 $lbs/ft^3$. Many foams will be in the range of 5.0 $lbs/ft^3$. With the variation in compressive strength values related to density, a generalized correlation of strength with density can be obtained.

The polymeric foam layer 18 is applied to the outside surface of the window structure when a storm is expected and upon drying, forms a layer of compressible material that acts as a temporary protective shield against glass window damage and shattering caused by projectiles and high winds. With the polymeric foam layer adhered to the glass pane as shown in FIGS. 2 and 3, the foam provides increased energy absorption from projectiles as compared with a non-foam polymeric layer due to the mechanical properties of the foam cell structure. The cells preferably have diameters in a range of from 0.005 mm to 5.0 mm and, most preferably, in a range of from 0.01 mm to 0.03 mm and create a spongy three-dimensional, elastomeric web pattern with entrapped gas to absorb energy. The polymeric layer 18 preferably has a thickness in a range of from 0.5 to 12.0 inches and, most preferably, in a range of from 1.0 to 4.0 inches to form an elastomeric, spongy cushion preventing shattering, breakage or fracture of the underlying glass.

When the glass pane is recessed in the frame 16, as shown in FIG. 3, the volume of the recess 26 is preferably filled with the polyurethane foam such that the polyurethane foam layer is coextensive with the exterior plane or surface of the building. If desired, the polyurethane foam layer 18 can be applied to overlay the frame 16 and can be formed from a single layer or coat of foam or a plurality of layers or coats of foam. When a plurality of foam layers are applied to form the temporarily protected window structure in accordance with the present invention, the layers are applied sequentially after at least partial curing of the underlying layer. Each of the layers or coats can have a thickness of from 0.5 to 12.0 inches.

The polymeric foam layer 18, formed of one or more layers or coats 18A as shown in dashed lines in FIG. 3, is applied to a window structure in a building in anticipation of storm conditions. The layer 18 can be sprayed onto the window structure with the use of a spraying device of a size to be held in the hand at a level with the window structure or operated from an extendible pole. Larger containers can be supported on the ground or on a truck and used with a spray head movable to be placed adjacent the window structure.

Figure 4:
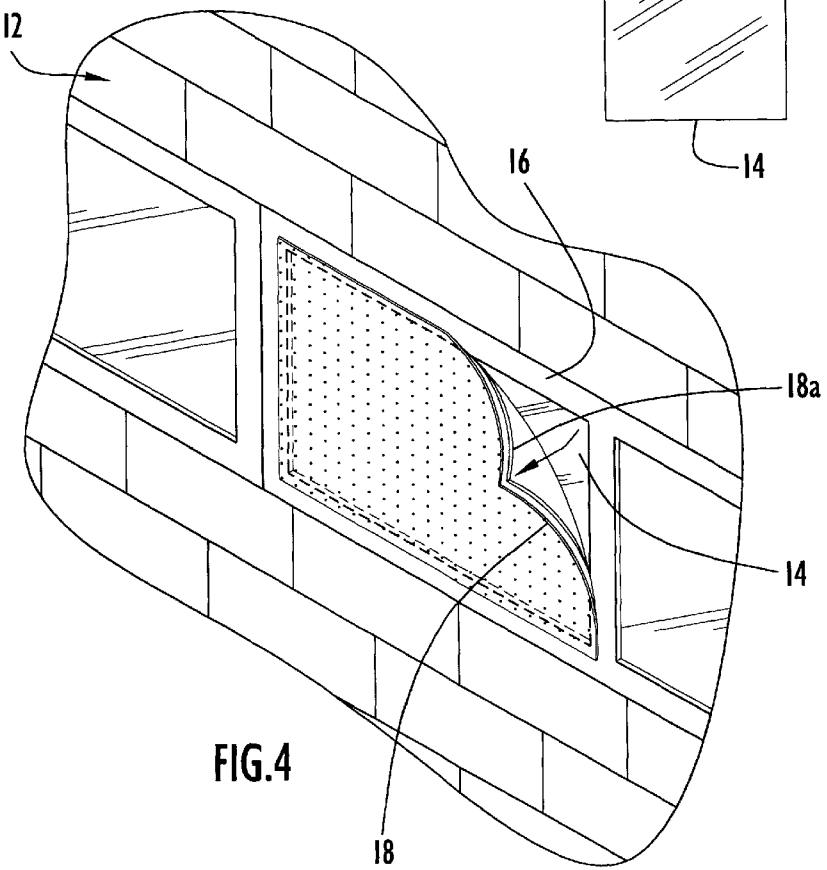
FIG. 4 is a perspective view of the window structure and polymeric foam layer of FIG. 2 with the polymeric foam layer being peeled from the window.

Once the storm passes, the polymeric foam layer 18 can be peeled from the window structure as shown in FIG. 4. If a plurality of layers or coats 18A are used, the layers can be peeled from the window structure individually or simultaneously. The foam layer 18 can be removed from the exterior of the building; or, if the window structure is movable (e.g.

pivotal or on tracks), the foam layer can be removed from the interior of the building without the use of a ladder by opening the window structure slowly and pulling the foam layer into the building. If the windows are not movable (do not open), an extension arm or pole can be used to remove the foam layer.

Figure 5:
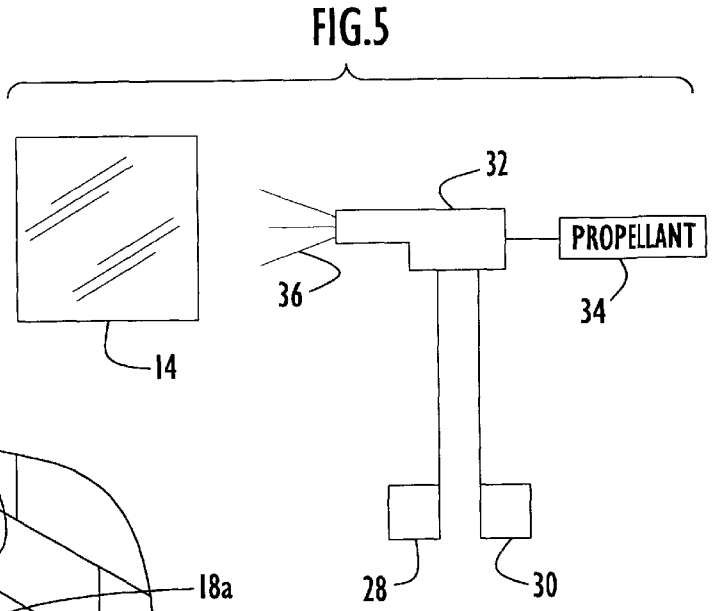
FIG. 5 is a schematic showing a two-component polyurethane system in accordance with the present invention.

A two-component polyurethane foam system is shown schematically in FIG. 5 wherein a canister 28 contains diisocyanate and a canister 30 contains polymeric polyol, the canisters communicating with a static mixing head 32 under pressure from a propellant 34. The diisocyanate and the polymeric polyol are mixed under the propellant's pressure and sprayed, as shown at 36, onto a window structure. As soon as the polymeric blend hits the glass pane 14, foaming will start, and a desired polymeric foam thickness is achieved. As noted above, additional layers or coats can be applied for extra protection. The polymeric foam layer will be dry to the touch within minutes after application and will be completely cured in a few hours. A catalyst can be added if curing time is desired to be decreased. A one-component polyurethane foam system is similar with the exception that a higher viscosity polyurethane prepolymer is used that is moisture cured by atmospheric humidity.

An example of a two-component spray polyurethane foam system is the FROTH-PAK system marketed by Flexible Products Company Construction Group, of Joliet, Ill.

Inasmuch as the present invention is subject to various modifications and changes in detail, it should be appreciated that the preferred embodiments described herein should be considered as illustrative only and should not be taken in a limiting sense.

What is claimed is:

1. A method of protecting a glass pane installed in a building from damage during a storm comprising the steps of before the storm arrives, applying a polymeric foam layer to the exterior of the glass pane; and after the storm has passed, peeling the polymeric foam layer from the glass pane.

2. A method of protecting a glass pane as recited in claim 1 wherein said applying step includes applying a polyurethane foam to the exterior of the glass pane.

3. A method of protecting a glass pane as recited in claim 2 wherein said applying step includes, prior to applying the polyurethane foam, applying a low-adherency adhesive film to the glass pane.

4. A method of protecting a glass pane as recited in claim 2 wherein said applying step includes providing a one-component polyurethane system formed of a polymeric polyol/polyurethane prepolymer and a polymeric hydrocarbon propellant mixture in a container, spraying the polyurethane mixture from the container on the glass pane and curing the polyurethane mixture on the glass pane.

5. A method of protecting a glass pane as recited in claim 2 wherein said applying step includes providing a two-component polyurethane system formed of a polymeric polyol in a first chamber, a diisocyanate in a second chamber and a mixing head communicating with the first and second chambers to mix the polyol and the diisocyanate and spraying the mixed polyol and diisocyanate from the mixing head onto the glass pane.

6. A method of protecting a glass pane as recited in claim 1 wherein said applying step includes spraying a polyurethane foam onto the exterior of the glass pane to have a thickness ranging from 0.5 inches to 12.0 inches.

7. A method of protecting a glass pane as recited in claim 1 wherein said applying step includes spraying a polyurethane foam onto the exterior of the glass pane to have a thickness ranging from 1.0 inches to 4.0 inches.

8. A method of protecting a glass pane as recited in claim 1 wherein said applying step includes spraying a polyurethane foam onto the exterior of the glass pane, the foam containing cells having diameters of from 0.005 mm to 5.0 mm.

9. A method of protecting a glass pane as recited in claim 1 wherein said applying step includes spraying a polyurethane foam onto the exterior of the glass pane, the foam containing cells having diameters of from 0.01 mm to 0.03 mm.

10. A method of protecting a glass pane as recited in claim 1 wherein the glass pane is mounted to a frame and said applying step includes spraying a polyurethane foam layer onto the glass pane and a portion of the frame.

11. A method of protecting a glass pane as recited in claim 10 wherein the glass pane is recessed in the frame and said applying step includes filling the recessed volume with the polyurethane foam layer.

12. A method of protecting a glass pane as recited in claim 1 wherein said applying step includes applying a plurality of polymeric foam layers to the glass pane.

13. A method of protecting a glass pane as recited in claim 12 wherein said peeling step includes peeling each polymeric foam layer individually from the glass pane.

14. A method of protecting a glass pane as recited in claim 12 wherein said peeling step includes peeling the plurality of polymeric foam layers simultaneously from the glass pane.

15. A method of protecting a glass pane as recited in claim 1 wherein said applying step includes spraying a polyurethane foam and a catalyst on the glass pane.

16. A method of protecting a glass pane as recited in claim 1 wherein said applying step includes applying a styrene foam to the exterior of the glass pane.

17. A method of protecting a glass pane as recited in claim 1 wherein said applying step includes applying a high impact styrene foam modified with polybutadiene.

18. A method of protecting a glass pane installed in a building from damage during a storm comprising the steps of before the storm arrives, applying a polymeric foam layer to the exterior of the glass pane;

allowing the polymeric foam layer to dry so as to form a layer of compressible material over the exterior of the glass pane; and after the storm has passed, peeling the layer of compressible material from the glass pane.

* * * * *